US008176853B2

(12) United States Patent
Nemeth et al.

(10) Patent No.: US 8,176,853 B2
(45) Date of Patent: May 15, 2012

(54) AMUSEMENT PARK RIDE USING MOTION-DRIVEN POSITIONING FOR 360-DEGREE VEHICLE ORIENTATION

(75) Inventors: Edward A. Nemeth, Hermosa Beach, CA (US); David W. Crawford, Long Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 365 days.

(21) Appl. No.: 12/565,178

(22) Filed: Sep. 23, 2009

(65) Prior Publication Data

US 2011/0067594 A1 Mar. 24, 2011

(51) Int. Cl.
*A63G 25/00* (2006.01)

(52) U.S. Cl. ..... 104/75; 104/53; 104/57; 104/60; 104/139

(58) Field of Classification Search ..... 104/74, 104/75, 76, 81, 85, 53, 55, 56, 57, 63, 64, 104/60, 28, 130.07, 139
See application file for complete search history.

(56) References Cited

U.S. PATENT DOCUMENTS 921,416 A * 5/1909 Lauster ..... 104/64
3,554,130 A * 1/1971 Broggie et al. ..... 104/75
7,806,054 B2 * 10/2010 Baker et al. ..... 104/74

* cited by examiner

*Primary Examiner* — Mark Le
(74) *Attorney, Agent, or Firm* — Marsh Fischmann & Breyfogle LLP; Kent A. Lembke

(57) ABSTRACT

An amusement park ride adapted for fully rotating a passenger compartment in response to vehicle motion along a guide track. The ride includes a vehicle chassis that engages the guide track and travels along the ride path during operation of the ride. The ride further includes a cam-based positioning assembly that is supported by the vehicle chassis to move with it along the guide track. The positioning assembly operates in response to being moved along the guide track to rotate the passenger compartment. The positioning assembly rotates the passenger compartment in counterclockwise and clockwise directions to provide 360-degree rotation. The positioning assembly includes a cam shaft with three cam follower pairs offset along the shaft and extending outward from the shaft at angular offsets, and three cam rails are used to selectively position the followers to rotate the cam shaft and set the position of the passenger compartment.

15 Claims, 5 Drawing Sheets

AMUSEMENT PARK RIDE USING MOTION-DRIVEN POSITIONING FOR 360-DEGREE VEHICLE ORIENTATION

BACKGROUND OF THE INVENTION

1. Field of the Invention

The present invention relates, in general, to amusement park rides and payload delivery systems in which orientation of a payload such as a vehicle is controlled and selectively adjusted, and, more particularly, to a motion-driven positioning assembly for use in amusement park rides and other payload delivery systems using a cam assembly or mechanism to provide selective and/or continuous positioning of a payload such as passenger vehicles about a drive axis (or with 360-degree or full rotation of a positioning mechanism, such as a rotatable shaft, to selectively position attached vehicles or other payloads relative to a guide or ride track).

2. Relevant Background

Within the amusement park industry, there are many rides where it is desirable to alter the orientation of a vehicle as it moves along a track (e.g., a guide or ride track). For example, a themed show may be presented adjacent the track of a ride on either side of the direction of travel. In these rides, it may be desirable to rotate the vehicle body to better allow the passengers to view the show or experience a special effect.

As will be appreciated, there are many instances within theme or amusement parks that utilize controlled orientation of a payload on a moving platform such as guest compartments or bodies on ride vehicles or animated set pieces that may move about on a guide track system (e.g., the show portion of a ride may itself include show pieces moving about on a track with rotating or changing orientation payloads or aspects). Outside of the amusement park industry, tracks are used to guide payloads through factories and other settings with it often being desirable and useful to rotate or change the orientation of the payload relative to the direction of travel or the guide track.

Currently, amusement park rides typically use a mechanical cam system or a controlled motor-driven system to achieve a desired payload orientation along a vehicle track. An exemplary mechanical cam-based ride may include a payload platform that rotates as a cam follower or the cam itself contacts a surface near the guide track as the arm or platform moves in a direction of travel along the track. Mechanical cam systems are simple, reliable, repeatable, and provide a high level of assurance that a particular orientation of the payload will be achieved at a given point along the vehicle track. A drawback, though, of cam systems is that they only provide a limited angular variation around the cardinal orientations (e.g., forward along the track, backward along the track, track left, and track right). For example, many cam systems only allow the payload such as a passenger compartment to be rotated 45 degrees to the left or right relative to the guide track (or direction of travel). It is typically not possible, using existing cam orientation or positioning systems, to selectively rotate the payload over a full range without eventually encountering the end of possible rotation. At this point, further rotation in the current direction is no longer possible and the only rotation available or that can be provided is back in the opposite direction (have to rewind the payload or earn system in some senses).

Motor driven positioning or orientation systems are useful for providing an unlimited range of motion including rotating a payload in either rotation direction to any coordinate in a 360-degree range, but motor driven systems present other design challenges to designers of amusement park rides or others attempting to orient a moving payload relative to guide track. For example, a motor-driven system generally requires electrical power on the vehicle, which forces a designer to provide provisions for failure of the power or motor system (e.g., failure to rotate or unpredictable moves during a controller fault). In many cases, this causes a ride designer to increase the ride envelope provided near the vehicle to make sure that even a failed position or orientation would pass through the envelope (e.g., increase a diameter of a tunnel such that even if a support arm fails in an extended or outboard position the vehicles will not contact the tunnel wall). Generally, this means that motorized systems cannot be used in close proximity to fixed elements such as set pieces and secondary devices may have to be provided to stop a vehicle from entering an area with its payload or vehicles in an unplanned or non-design orientation such as an emergency stop if a misaligned guest compartment is coming into a station area on a ride. Further, motor driven systems often require accurate and continuous measurement of the vehicle track position and orientation of the payload to provide proper control over the drive mechanisms and achieve desired positioning of the payload. In other words, the workspace of the vehicle has to be extended to all possible positions the vehicle is capable of achieving such that designers of such systems have to make sure nothing can collide with the workspace envelope.

There remains a need for improved positioning methods and systems for payloads such as passenger compartments that are moved along a ride path or track. Preferably such methods and systems would allow for smaller or tighter envelopes about the guide track to reduce space requirements and allow for desired ride effects (such as a near miss of a ride vehicle when a tunnel is approaching or is getting smaller). Also, it is typically desirable that the positioning methods and systems be adapted to provide an unlimited range of motion or rotation while also providing reliable positioning in critical situations (e.g., a guaranteed safe position of a passenger compartment along a guide track relative to set pieces or an envelope boundary).

SUMMARY OF THE INVENTION

The present description provides a cam-based positioning or rotation assembly for use in payload delivery systems such as amusement park rides to position a payload or vehicle compartment with full and continuous rotation (e.g., 360 degree rotation) in either rotation direction (e.g., clockwise or counterclockwise directions). The cam-based positioning assembly is driven by vehicle movement along a guide track rather than being motor driven so as to overcome issues with failure outside a system envelope about the guide track.

In an exemplary embodiment, a cam mechanism is provided that includes a cam or positioning shaft pivotally supported in a vehicle chassis, with the chassis engaging and rolling along a direction of travel relative to the guide track (e.g., rails defining a ride path). Three pairs of cam follower arms are provided to extend outward at angular offsets (e.g., adjacent follower arms are spaced apart 60 degrees) from the sides of the cam shaft, and each pair of follower arms is provided at a differing height or position along the shaft (e.g., an upper follower arm pair in an upper plane, an intermediate follower arm pair in an intermediate spaced apart but parallel plane, and a lower follower arm pair in a lower spaced apart but parallel plane). A set of cam rails is provided along the guide track to provide contact surfaces for the follower arms at locations along the ride path to selectively rotate or angularly orient/position the payload such as a vehicle compartment. In one embodiment, one follower arm engages a cam rail at a sloped or inclined segment to apply a rotation force to cause the cam shaft to rotate a desired amount (e.g., up to about 60 degrees) at a desired rate (which is set by the size of the incline and speed of the vehicle with a greater incline and higher speed causing more rapid rotation). A second follower arm may concurrently (and continuously or periodically) engage a second cam rail to limit or control over rotation of the cam shaft.

The rotation occurs in response to movement of the vehicle support (or vehicle assembly including such a support) relative to a guide track that defines a path for the amusement park ride. The ride includes a vehicle chassis that engages, such as with a set of wheels or rollers, the guide track, and the chassis travels along the ride path during operation of the ride. The ride further includes a cam-based positioning assembly that is supported on or by the vehicle chassis so as to move with it along the guide track. The positioning assembly is connected to the vehicle support and operates in response to being moved along the guide track to rotate the passenger compartment. The positioning assembly is able to first rotate the passenger compartment in a counterclockwise direction and to second rotate the passenger compartment in a clockwise direction in first and second sections/segments of the guide track. The positioning assembly may provide full and continuous rotation, e.g., to rotate the passenger compartment more than 360 degrees about a rotation axis.

The cam-based positioning assembly typically includes a cam shaft that is pivotally mounted in the vehicle chassis with an end extending up into or near the vehicle support to provide a rotating output used to rotate the passenger compartment. The positioning assembly may include first, second, and third cam followers connected to the cam shaft and with arms extending outward from the cam shaft at angular offsets of about 60 degrees (e.g., each arm is spaced apart 60 degrees from one or more adjacent arms). The cam followers may have longitudinal axes that are each extending in first, second, and third rotation planes, respectively, and these three planes may be parallel to each other but spaced apart such that the first cam follower is an "upper" follower, the second cam follower is an "intermediate" follower, and the third cam follower is a "lower" follower (e.g., each follower arm pair is spaced apart such that each pair may be independently actuated with a cam rail without interference).

The positioning assembly may also include first, second, and third cam rails associated with the first, second, and third cam followers and extending along at least portions of the guide track to provide contact surfaces for the associated ones of the cam followers to provide a rotation force for selectively rotating and setting an angular orientation/position of the cam shaft. In one embodiment, the contact surfaces are inclined relative to the guide tracks (e.g., sloped toward or away from the nearby guide track), and the cam rails each have a profile along the ride path that defines an angular position of the cam shaft at each point along the guide track by defining or controlling a position of the associated one of the cam followers relative to the guide tracks. In some cases, one of the cam followers engages one of the contact surfaces to apply the desired rotation force to cause the rotation of the cam shaft in a first direction while another one of the cam followers concurrently engages one of the contact surfaces to limit over rotation of the cam shaft in that first direction (e.g., to limit the amount of counterclockwise or clockwise direction produced by engaging a cam rail with a cam follower arm).

DETAILED DESCRIPTION OF THE PREFERRED EMBODIMENTS

Figure 1:
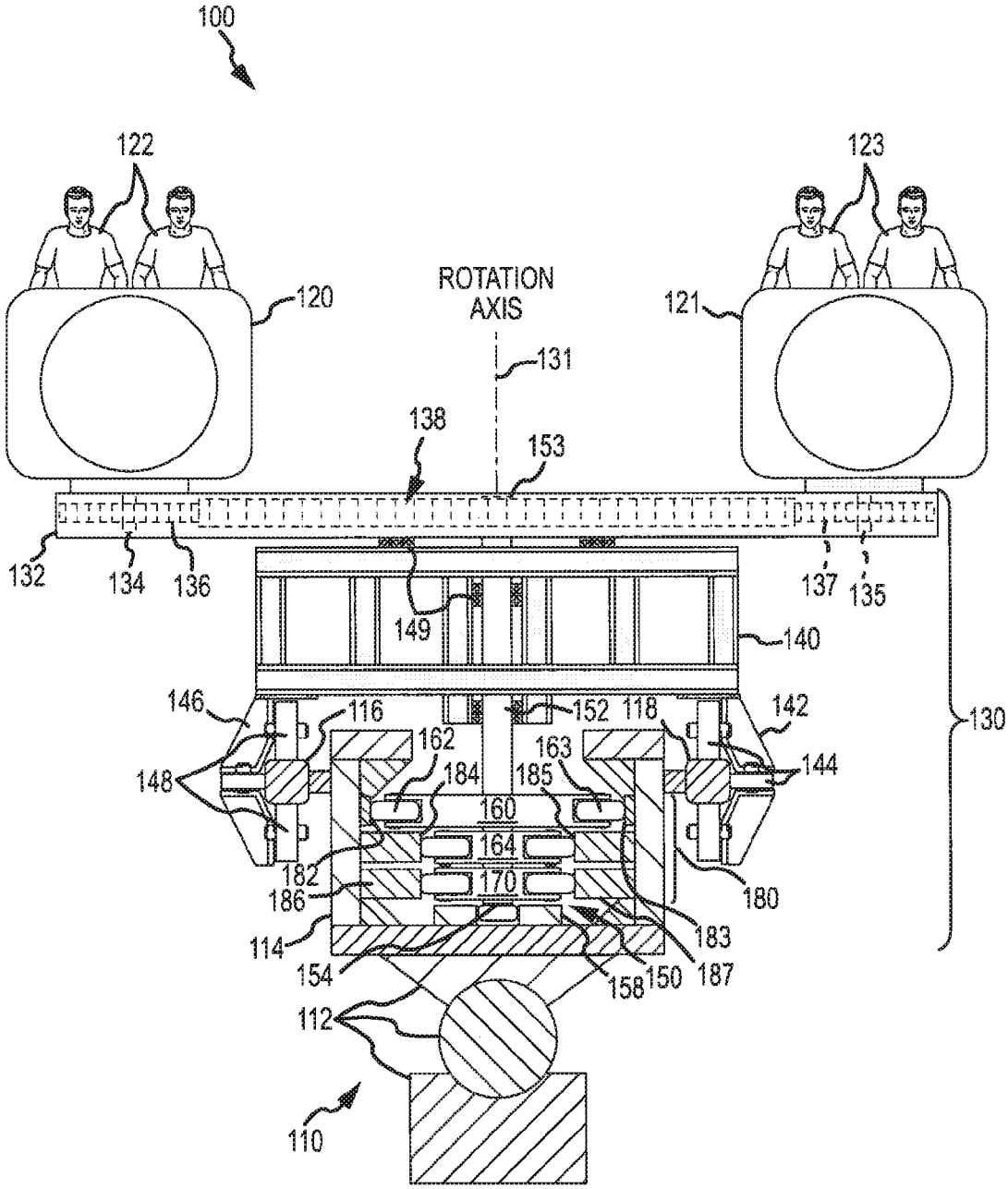
FIG. 1 shows an end sectional view of a payload delivery or ride system of an embodiment of the invention including a 360-degree, cam-based positioning assembly.

The following description begins with an overview of a cam-based positioning or orientation assembly for use in positioning a payload in an amusement park ride or payload delivery system. For example, the ride or system may be a system used to selectively position a payload such as a passenger compartment or vehicle, a set piece, a fabricated part in a factory setting, and the like as the payload is being moved along a direction of travel defined by a guide track or rail(s). The cam-based positioning assembly may be thought of as a 360-degree cam system or mechanism that is capable of controlling the orientation of a payload (relative to a guide track or a direction of travel along such track) over a full range of motion.

To this end, for example, a positioning shaft or cam shaft may be rotated in either direction (clockwise or counterclockwise) continuously or selectively along the length of the guide track to provide 360-degree positioning of one or more payloads linked to the positioning/cam shaft. The payload can be continuously or selectively rotated in either direction and also at nearly any speed, and a desired orientation may be held at any orientation for a desired length of the track (e.g., rotation of the shaft is not required in all portions of the guide track).

The cam-based positioning or orientation assembly includes a set or assembly of cam followers (or drive arms) linked to a cam or positioning shaft and further includes a set of cam rails provided along or near a guide track. The guide track is used to define a travel path and/or direction of travel for the payload or ride vehicle, e.g., one or more vehicle assemblies may be propelled along the guide track. The cam follower assembly may include two or more pairs of arms, with three pairs of arms being used in some embodiments, that extend outward from the positioning or cam shaft (or a common axle about which rotation/positioning of the payload is provided). In the three-pair example, each arm of a pair is oriented to be 180 degrees from each other (e.g., to extend outward from opposite sides of the common axle/shaft). Each of the pairs of follower arms is fixed to the common axle/shaft at a different offset along the periphery or outer wall of the axle/shaft, such as at 60-degree offsets to provide a follower arm every 60 degrees about the circumference of the cam shaft. Significantly, each of the pairs of follower arms is provided in a differing mounting (or rotation) plane along the longitudinal axis of the cam shaft such as in parallel but offset mounting planes that are orthogonal to the cam shaft (e.g., each pair of the arms may have a longitudinal axis and the axes may be in offset and parallel planes).

The cam rails extend generally along the guide track to selectively contact the follower arms, or, follower wheels on the ends of such arms, to engage the arms to position and rotate the interconnected cam shaft and associated payload(s). Hence, the rails may be thought of as extending in offset and parallel planes to separately contact the differing pairs of follower arms (e.g., be at differing distances from the guide track below or above (or to the side) of such a track). The number of cam rails along one side of the guide track typically matches the number of pairs of follower arms (at least where engagement or positioning is desired as some embodiments utilize discontinuous cam rails to reduce material costs). For example, three cam rails may be arranged along one side/rail of a guide track such that a contact wheel of one pair of the follower arms engages a cam rail. The cam follower arms not intended to be controlled by that cam rail may pass either above or below (or to the side) a distance from the cam rail without interference or contact.

While only one follower contact wheel needs to contact a rail at a time to cause the shaft to rotate about a positioning axis, some embodiments arrange the cam rails such that a second contact wheel in the same or a differing pair of cam follower arms is in or near to contact. In this manner, over rotation or over travel (due to momentum or other causes) of the shaft can be controlled with the cam-based positioning assembly. In this arrangement, operation involves at least two cam follower pairs engaging rails at any given position along the length of the guide track (along the ride path defined by the guide track). Typically, the two contacting follower arms are in differing arm pairs such that two cam rails are contacted concurrently. One cam rail may be used for providing either a motive or a holding force upon the follower arm in one rotation direction while the other or second cam rail is used to act to prevent over rotation of the payload.

If the payload (i.e., cam shaft) is not rotating, the cam followers may simply follow their respective rails and be spaced apart or may be continuously or periodically contacting the rails to provide counteracting forces to hold the payload (and cam shaft) in the desired orientation. If the payload (and cam shaft) is rotating, the cam followers make and break contact with their respective cam rails as the cam-based positioning or orientation assembly rotates and the motive and holding forces are transferred from one cam follower arm to another over a full rotation of the cam shaft. In this manner, the cam-based positioning or orientation assembly provides continuous or selective rotation in either a clockwise or counterclockwise direction at one or more controlled rotation rates/speeds (as may be adjusted, for example, by changing the slope of a cam contact segment of a cam rail with steeper slopes or causing more rapid rotation).

FIG. 1 illustrates a portion of an amusement park ride 100 (e.g., a payload delivery system in which the payload is a passenger compartment/passengers) that may utilize a cam-based orientation technique of an embodiment of the present invention. As shown, the ride 100 includes a guide track assembly 110 and a cam-based orientation or positioning assembly 130 that is utilized to selectively position first and second vehicles or passenger compartments 120, 121 holding a payload or passengers 122, 123. The energy to position the payload or compartments 120, 121 is provided by cam-based orientation assembly 130 itself as it moves along the guide track assembly 110 such that loss of power does not affect its ability to position the compartments 120, 121 (e.g., if the assembly 130 is moving down the track members 116, 118 positive positioning is provided). The assembly 130 provides a mechanical drive that does not have a fault condition, as was the case with electrical motors, that may move a payload outside a normal operating ride envelope. Further, the assembly 130 provides 360-degree positioning that may progress in either direction (clockwise or counterclockwise about a rotation axis 131) along the track members 116, 118 to provide full angular positioning in contrast to prior mechanical drives.

The track assembly 110 is used to define a path for the ride 100 and may place the compartments 120, 121 adjacent show elements to provide a themed ride. It may be desirable to this end to selectively rotate or position the compartments 120, 121 such as to rotate the compartments 90 degrees to the left or right to view a show. The track assembly 110 includes structural or frame portions 112 that are used to physically support the compartments 120, 121 and the positioning assembly 130 in the ride. Further, rails supports 114 may be used to support track members 116, 118 that are used to defined a path in the ride 100 and to also provide a contact or rolling surface for the cam-based positioning assembly 130, which may be caused to move along the track members 116, 118 in any of a number of ways well-known in the amusement park and other industries.

The cam-based positioning assembly 130 includes a payload support platform or arm 132 that supports the compartments 120, 121 (the payload). The platform 132 is supported on vehicle chassis 140 with bearing assemblies 149 provided for smooth rotation of platform 132 on chassis 140 and cam/positioning shaft 152 relative to chassis 140. Wheel hubs or mounting elements 142, 146 extend from the chassis 140 opposite the platform 132 and are used to pivotally support contact wheels/rollers 144, 148 that rollably engage the guide track members 116, 118 to allow the chassis 140 and supported platform 132 (and shaft 152) to travel along the path defined by the guide track 110 during operation of the ride 100.

To provide accurate positioning of the vehicle compartments 120, 121, the cam-based positioning assembly 130 includes a cam follower assembly or cam mechanism 150. The assembly 150 includes a positioning or cam shaft (or common axle) 152 that extends transverse or orthogonal to the support platform 132. The shaft 152 has a center axis that defines a rotation axis 131 for the assembly 150, and rotation of the shaft 152 is used to provide the driving input to selectively position or rotate the compartments 120, 121 and/or the support platform 132. Compartments 120, 121 and/or the support platform 132 may be directly coupled to cam mechanism 150 such that one rotation of assembly 150 produces one rotation of platform 132. Alternatively, a gear/belt/chain/other system may be introduced between assembly 150 and platform 132 such that one rotation of assembly 150 produces either more than one or less than one rotation of platform 132. The shaft 152 is attached at one end 153 to the drive mechanisms 138 of the payload 120, 121 and is supported for rotation at a second end 154 by a roller abutting guide rails 158 (e.g., defining a guide groove for shaft 152 to travel between track members 116, 118 while being allowed to pivot about axis 131).

To set the rotational position of the common axle or cam shaft 152, the cam follower assembly 150 includes a first or upper pair 160 of cam follower arms extending outward from each side of the shaft 152. Contact wheels or rollers 162, 163 are pivotally mounted on the ends of the arms of follower arm pair 160. The follower assembly 150 also includes a second or intermediate pair 164 of cam follower arms also extending outward from each side of the shaft 152 with pivotally mounted rollers or wheels 166, 167. Further, the follower assembly 150 includes a third or lower pair 170 of cam follower arms extending from each side (opposite sides) of the shaft 152 with pivotally mounted rollers or wheels 172, 173.

As explained below, the two arms of each cam follower arm pair 160, 164, 170 are 180 degrees from each other (or a single follower strut or arm may extend through the shaft 152) such that the arms extend out opposite sides of the shaft 152. Further, it can be seen that each pair 160, 164, 170 is spaced apart along the length of the shaft 152 (adjacent pairs are spaced apart a preset distance to allow the arms to pass over a cam rail that is being used to set/control the rotational position or orientation of the shaft 152). In other words, each pair 160, 164, 170 is in offset but parallel rotational planes, which are transverse or, in some cases as shown, perpendicular to the rotation axis 131. Also, each pair of follower arms is angularly offset from an adjacent pair of follower arms such that the arms may be selectively engaged to set the rotational or angular orientation of the shaft 152. For example, when three pairs are used in assembly 150, the longitudinal axes of adjacent arm pairs may be offset by about 60 degrees such that an arm is provided about every 60 degrees about the circumference or periphery of the shaft 152.

The shaft 152 is rotated during operation of the ride 100 in response to motion of the vehicle support chassis 140 relative to the guide track 110, with the movement of the chassis 140 causing a rotational force to be applied to the cam or positional shaft 152. To this end, the cam-based positioning assembly 130 includes a set or number of cam rails 180 that are positioned adjacent the guide track members 116, 118. As shown, the set 180 includes a pair of upper cam rails 182, 183 positioned on rail supports 114 in the rotation plane of upper follower arm pair 160, and the rails 182, 183 provide a contact surface for the wheels 162, 163 relative to the rotation axis 131 that sets a position of the follower arms of pair 160 (in FIG. 1 shown to extend be rotated outward to be orthogonal to the direction of travel of the guide track members 116, 118). The set 180 further includes a second pair of cam rails 184, 185 (or intermediate rails) attached to the rail supports 114, and these rails 184, 185 provide a contact surface for contact wheels 166, 167 of follower arm pair 164. The rails 184, 185 are shown in FIG. 1 to extend outward from the supports 114 further than rail 182, 183 thus causing the arms of pair 164 to be positioned or rotated toward the direction of travel (or the ride path) of the chassis 140. The set 180 includes a third pair of cam rails 186, 187 (or lower cam rails) attached to the rail supports 114, and the rails 186, 187 provide contact surfaces for wheels/rollers 172, 173 of follower arm pair 170 to set the position of the arms of pair 170 (e.g., also relatively close to the ride path or direction of travel in this illustration). Although the wheels of the follower pairs are shown to all be contacting the cam rails, the ride 100 typically will be designed such that only one or two wheels will contact the rails at a time such as one to apply a rotation force and one to continuously or periodically provide an over-rotation control force.

Figure 2:
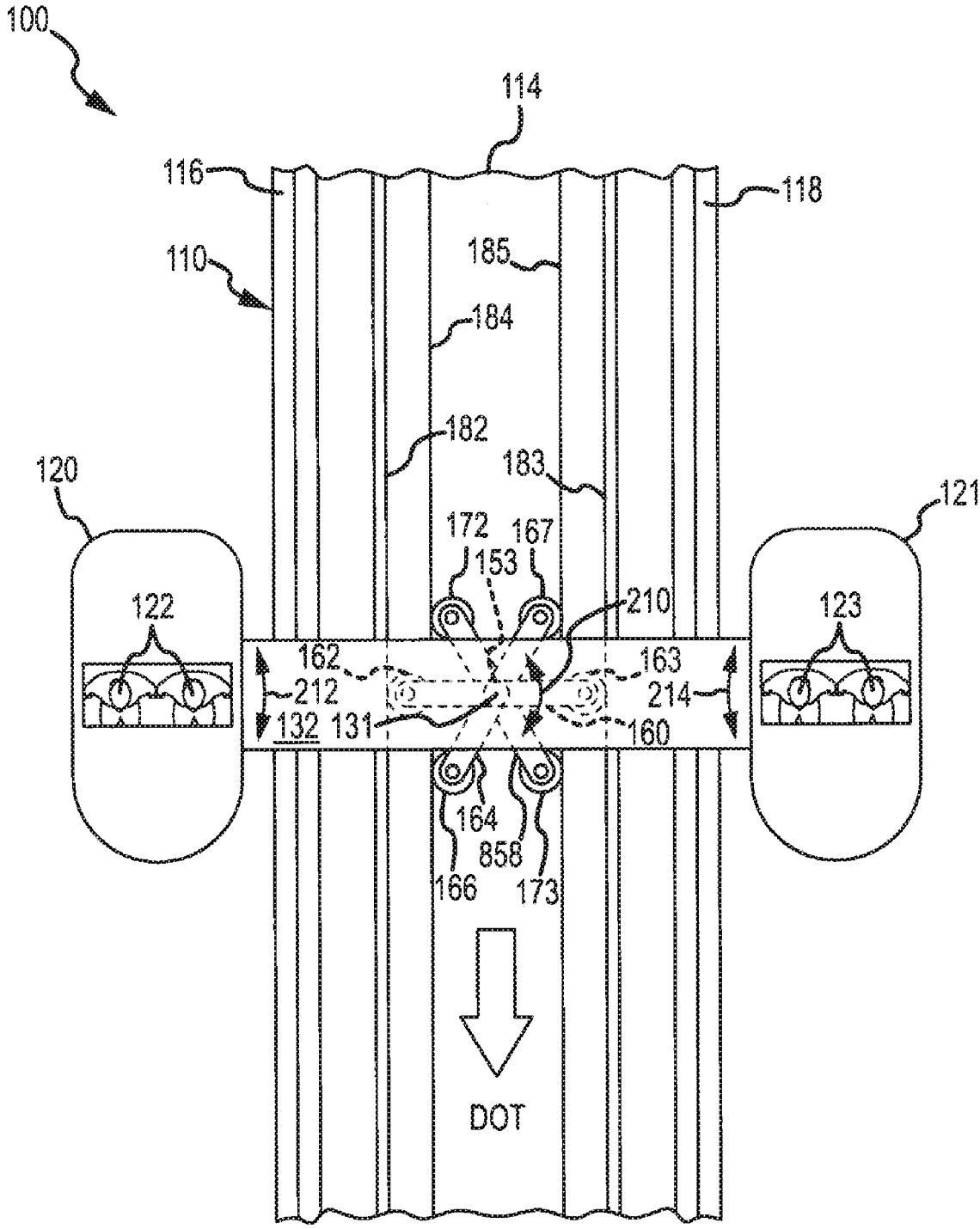
FIG. 2 shows a top or plan view of the system of FIG. 1 showing positioning assembly including cam followers being guided or controlled by cam rails to rotate the positioning shaft or cam shaft (which is linked by gear train/assembly to vehicles or payload)

FIG. 2 illustrates a plan or top view of the ride 100 showing the support arm traveling with chassis 140 along the guide track members 116, 118 in a direction of travel (DOT). In response to this movement of the chassis 140, the cam-based positioning assembly 130 is also moved along the track 110. This causes a rotational force to be applied by the cam rails 182-187 to one, two, or more of the contact wheels 162, 163, 166, 167, 172, 173 to position the sets 160, 164, 170 of the follower arms, which causes the positional or cam shaft 152 to rotate (with end 153 being shown to rotate in either direction about rotation axis 131 via arrow 210). However, the portion of track 110 shown in FIG. 2 is generally a steady-state section (as opposed to segments/portions shown in FIG. 5) with the cam rails 182-187 extending parallel to the guide track members 116, 118, which would retain the shaft 152 in a single angular or rotational position. By having the rails 182-187 slope inward and outward the rotation 210 may be controlled along the track 110 with movement of the chassis 140 and pivotally supported cam-based positioning assembly 130. In some embodiments, rotation of the arm 132 and/or compartments 120, 121 occurs with or in response to the rotation 210 as is shown with arrows 212, 214 for compartments 120, 121.

Figure 3:
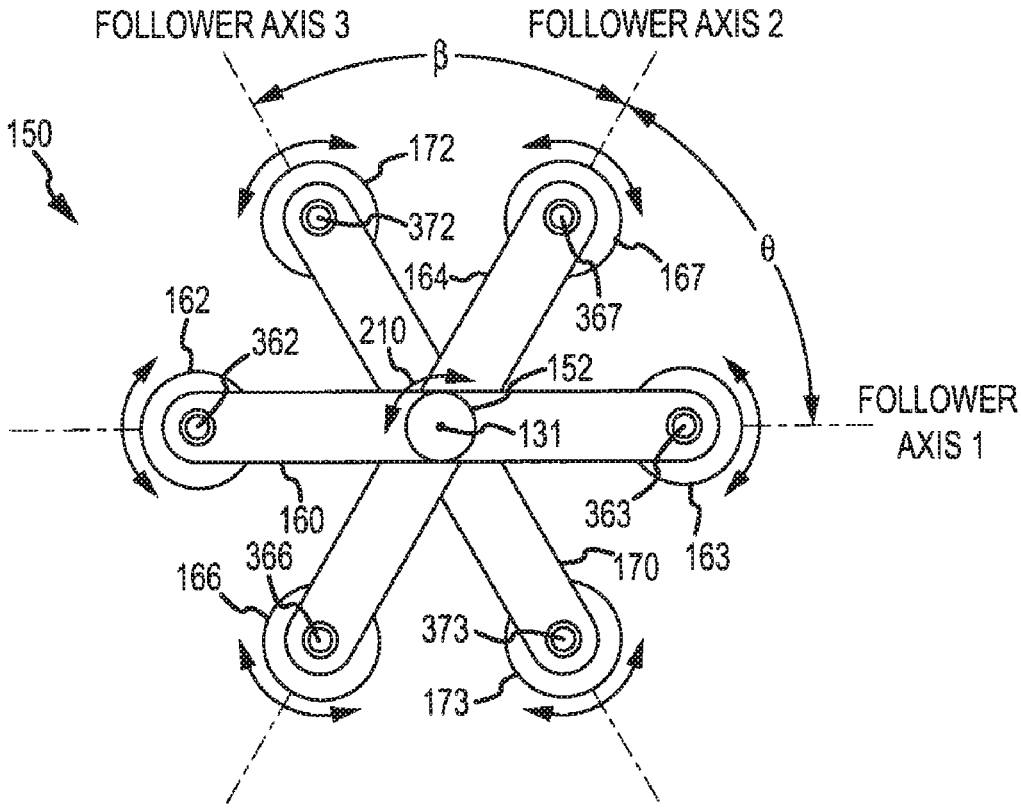
FIG. 3 shows a plan view of the cam assembly or mechanism of the system of FIGS. 1 and 2.
Figure 4:
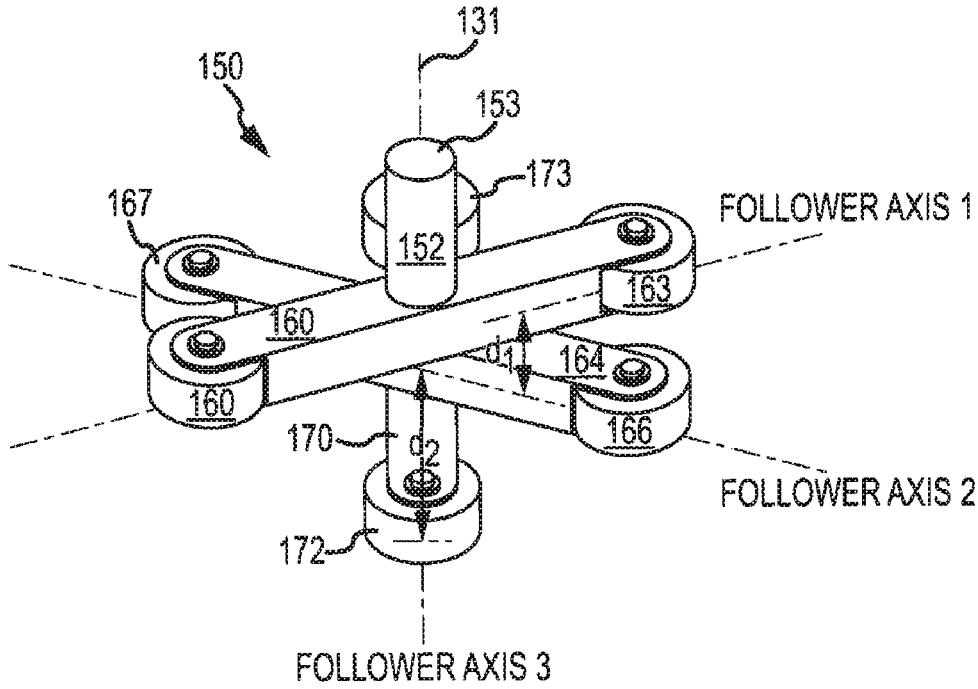
FIG. 4 shows a perspective view of the cam assembly or mechanism of the system of FIGS. 1-3 showing use of three cam followers/driver arms with longitudinal axes in three differing planes (e.g., spaced apart but parallel planes)

FIGS. 3 and 4 provide top and perspective views, respectively, of the cam-follower arm assembly 150 providing further details of the three-follower arm pair embodiment of the invention. In other embodiments, two pairs of arms or four or more may be used to provide desired positioning of a coupled positioning or cam shaft. As shown, cam shaft 152 has a central axis 131 that is the rotational axis of the assembly 150, and the shaft 152 is preferably mounted to rotate 210 in either direction in a ride support structure (which travels along the guide track). The rotation 210 occurs when one of the wheels or rollers 162, 163, 166, 167, 172, 173 abuts or engages a nearby surface such as a contact surface of a cam rail.

As shown in FIG. 3, the first or upper arm pair 160 has two arms that extend out either side of shaft 152 along a first follower axis (e.g., a single longitudinal axis extends through the arms). Pins or axles 362, 363 provide a pivotal mounting for the two follower wheels or rollers 162, 163. The second or intermediate arm pair 164 has two arms that extend out either side of shaft 152 along a second follower axis. Pins or axles 366, 367 provide pivotal mounting for wheels or rollers 166, 167 at the end of each of these follower arms. The first and second follower axes are positioned at an angular offset, $\theta$, of about 60 degrees. Similarly, the third or lower arm pair 170 has two arms that extend out opposite sides of shaft 152 along a third follower axis, which is at an angular offset, $\beta$, of about 60 degrees from second follower axis of second arm pair 164. In this manner, there is a follower arm in assembly 150 every 60 degrees about the circumference of the positioning or cam shaft 152.

In FIG. 4, it can be seen that the three follower axes of the three follower arm pairs 160, 164, 170 are in parallel rotation or mounting planes that are spaced apart distances, $d_1$ and $d_2$, to allow the arms to pass over cam rails used to force rotation of the shaft 152 via rigidly affixed follower arms. The distances, $d_1$ and $d_2$, typically are chosen to provide adequate clearances for the cam rails (e.g., the height of the rails plus a desired clearance amount).

The embodiment shown in FIGS. 1 and 2 of ride 100 included cam rails on both sides of the track assembly 110 to contact each of the follower arm pairs. For example, some embodiments of ride 100 may call for contact of all rollers/wheels of the followers, or, more typically, for one of the arms to be contacted at a time with both or one of the two wheels/rollers of that contact arm being in contact with rails on opposite sides of the guide track assembly 110. In other embodiments, one arm of one pair may be contacting a cam rail to provide rotation forces while another arm of another pair of follower arms may be used to limit over rotation such as by providing ongoing or periodic contact (such as when the rotation force roller/wheel becomes separated from the cam rail due to over rotation of the cam or positioning shaft). Cam rails on left of vehicle provide counterclockwise rotation and cam rails on right side of vehicle provide clockwise rotation.

Figure 5:
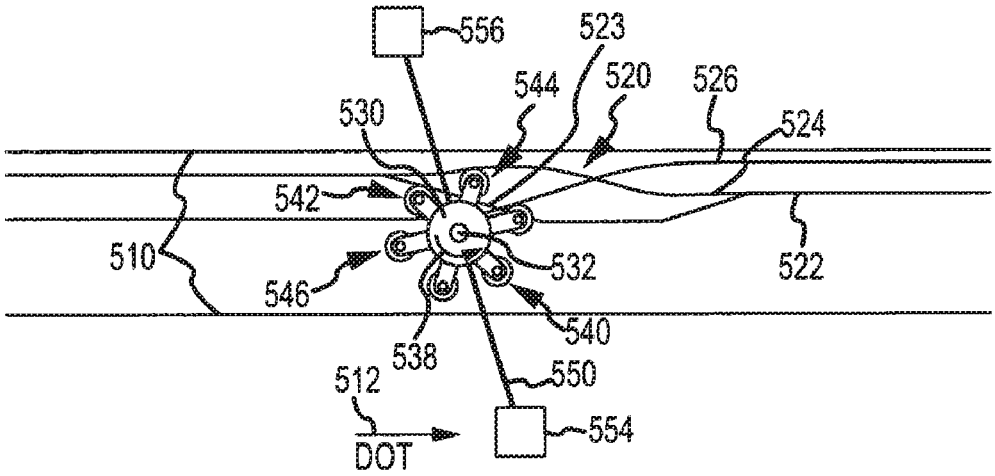
FIGS. 5-7 illustrate a payload or vehicle positioning system in a schematic manner showing use of cam rails on one side of a guide track to rotate the payload or vehicle bodies with movement of the vehicle assembly down the track or in a direction of travel along the vehicle guide track.
Figure 6:
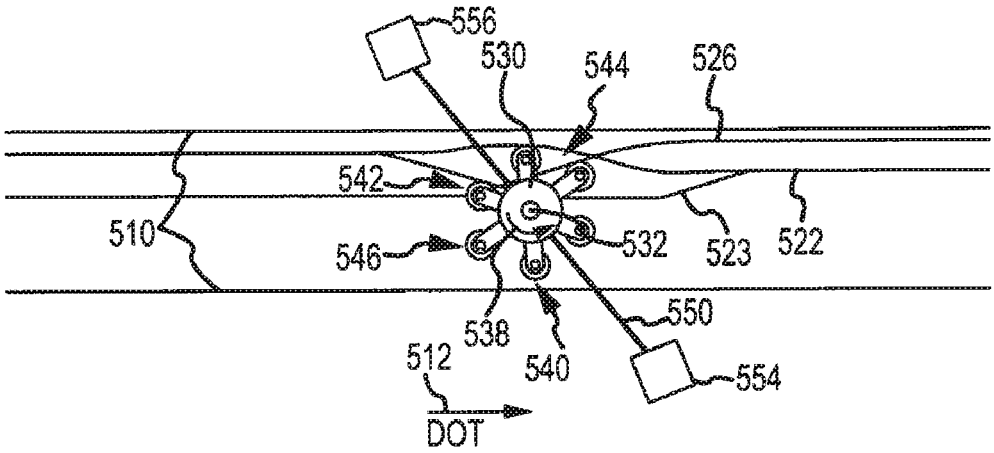
Figure 7:
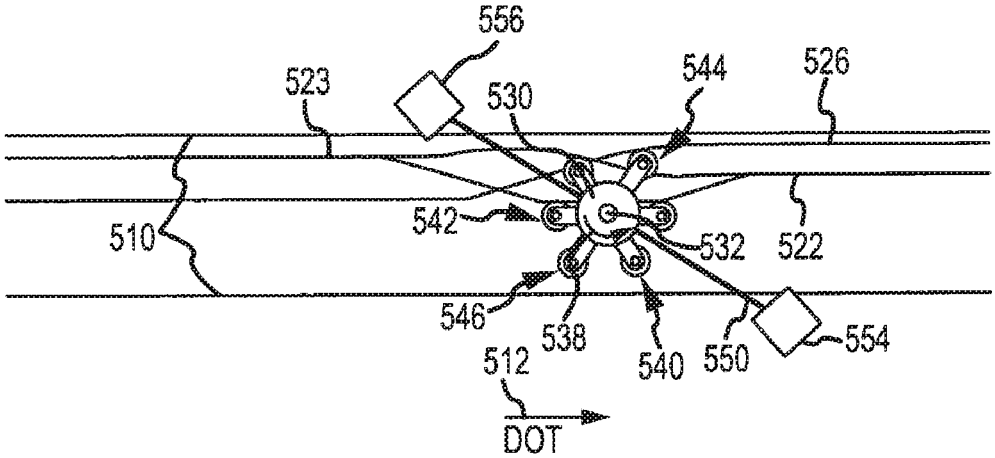

In other embodiments, though, cam rails are only provided on one side of the guide track at a time. FIGS. 5-7 illustrate schematically a ride or payload delivery system with a one-sided cam rail arrangement with the vehicle in three differing positions along the DOT 512, with the motion along the guide track 510 (and adjacent cam rails) causing the payload/vehicles to rotate. As shown, the system includes a guide track 510 such as a pair of rails used to support a vehicle assembly (including the cam-based positioning assembly and its components) and to define a path for the ride system. The system includes a vehicle support or platform 550 that supports a pair of vehicles 554, 556 (or payloads), and the platform 550 is attached or connected to a rotating vehicle element 530 (e.g., a cam shaft or centrally-located positioning member). The platform 550 is shown to rotate with rotation 538 of the rotating vehicle element 530 about the rotation axis 532.

The ride includes a cam follower assembly 540 including first, second, third follower arm pairs 542, 544, 546. The arm pairs 542, 544, 546 may be arranged as shown in FIGS. 1-4 to be in parallel but offset mounting/rotation planes and to be angularly offset by about 60 degrees such that follower arms extend outward from the surfaces of the rotating vehicle element 530 even/60 degrees. Each of the arm pairs 542, 544, 546 is rigidly attached to the rotating vehicle element 530 such that a force applied to the arms (such as by contact of their rollers/wheels with cam rails) urges the vehicle element or cam shaft 530 to rotate 538 about rotation axis 532 in either a clockwise or counterclockwise direction.

To accurately position the payloads 554, 556, a set 520 of three cam rails 522, 524, 526 are provided that are positioned at the same height or in the same plane as associated ones or paired ones of the follower arms 542, 544, 546. For example, as shown, the cam rail 522 may be paired or associated with follower arm pair 542, and, in FIG. 5 one of the wheels of cam follower pair 542 is contacting or engaging rail 522 in a sloped section (e.g., a segment or length of rail 522 that is position more proximate to the rotation axis 532). Due to the engagement between follower 542 and segment 523 of rail 522, the rotating vehicle element 530 is rotated 538 counterclockwise about axis 532. To control over rotation, rail 526 that is associated or paired with cam follower 546 engages (continuously or only periodic upon over rotation in which wheel of follower 542 become separated a preset distance (such as 1 to several inches or more) from cam rail 522) the roller or wheel of the follower 546. In this position shown in FIG. 5, the follower 544 may be still in touch with its paired or associated cam rail 524 as part of a "hand-off" to cam follower 142.

In FIG. 6, the ride is shown with the vehicle assembly further along the DOT 512 on vehicle guide track 510 (e.g., further to the right in the illustration). This causes the rotating vehicle element 530 to rotate further 538 counterclockwise, which, in turn, changes the position of the payload or vehicle compartments 554, 556 relative to the guide track 510 and DOT 512. The rotation 538 is controlled by the slope of rotation segment 523 that moves the cam follower 542 into a position that is more parallel to the guide tracks 510 (or a path of the axis 532 between such tracks/rails 510). The follower arm 544 is now separated from rail 524 while follower 546 is abutting or near to over-rotation control segment in cam rail 526 (which may have the same or a similar slope/incline as segment 523).

In FIG. 7, the ride system is shown with the vehicle assembly still further along the DOT 512 on vehicle guide track 510. The further movement causes the rotating vehicle element 530 to further rotate 538 in the counterclockwise direction to reposition the arm/platform 550 and supported payload/vehicle compartments 554, 556. In this position, all three of the followers 542, 544, 546 may be in contact or near to engagement with cam rails 622, 624, 626, respectively, as positional/rotational control is being "handed off" to an adjacent one of the follower arm pairs 544 or 546 from follower arm pair 542.

The specific angular position of the rotating vehicle element or cam shaft 530 may be set by the relative position of the cam rails 522, 524, 526 to the center axis 532 of the element/shaft 530. The speed of rotation may also be selected by the degree of slope/incline of the rotational engagement sections, taking also into account the speed of the vehicle assembly along the DOT 512. For example, a 30 degree incline or slope in segment 523 of cam rail 522 will cause a particular rate of rotation while a 45 degree incline or slope in segment 523 would cause a different, faster rate of rotation of the rotating vehicle element 530 at a particular vehicle speed along the guide track 510. As will be understood, the variations of the cam rail 120 arrangements is nearly limitless, with those skilled in the art readily understanding based on the rides of FIGS. 1-7 that design parameters may be selected to achieve a desired payload positioning by selective rotation of the cam shaft/rotating vehicle element along the length of the guide track or ride path of such a track.

Figure 8:
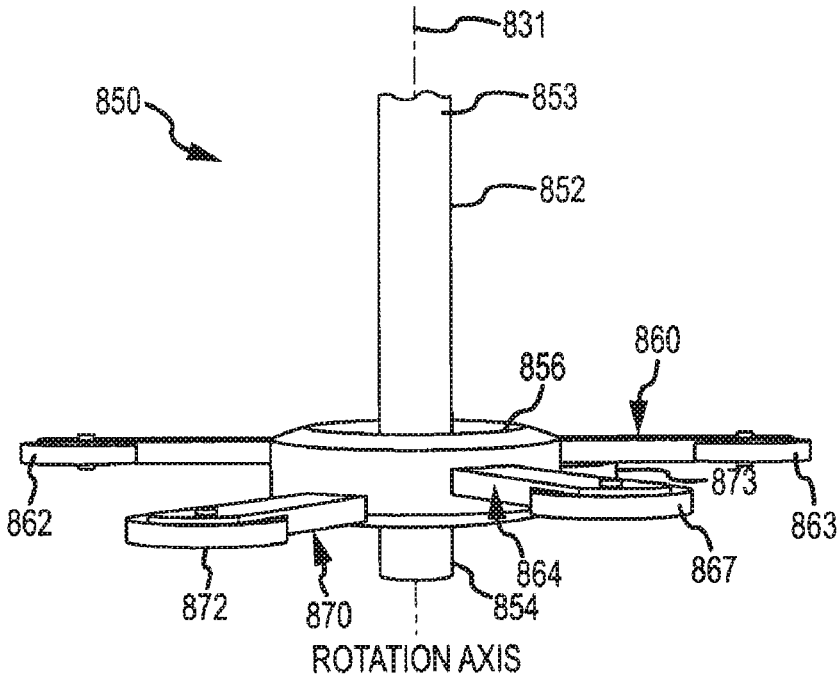
FIG. 8 shows a side view of another cam mechanism or assembly of the invention.
Figure 9:
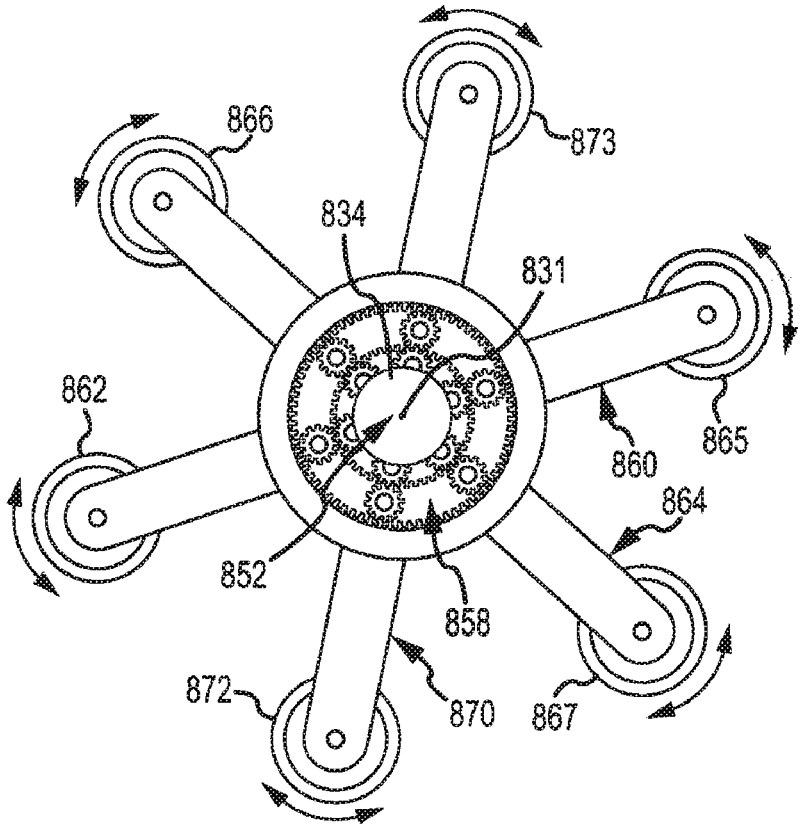
FIG. 9 shows a plan view of the cam mechanism of FIG. 8 showing use of a gear assembly to control movement of a positional shaft or camshaft (or rotational vehicle element) in response to movement of cam follower arms when cam follower wheels contact cam rails (not shown).

Since the cam-based positioning assemblies described herein are capable of continuous, controlled rotation in either direction, it may be desirable in some cases to include a gear box or assembly or other means of mechanical advantage. FIGS. 8 and 9 illustrate another cam follower assembly 850 that may be used in a ride or payload delivery system to provide a full range of rotation that is vehicle motion actuated or driven as is the case in the rides/systems of FIGS. 1-7. The assembly 850 includes a cam or positioning shaft 852 that rotates about its central axis 831 (e.g., the rotation axis of the assembly 850). The shaft 852 may be attached at an output or drive end 853 to a payload or vehicle rotation assembly (such as the platform and gears shown in FIG. 1) such that the payload is positioned and/or rotated in response to and/or based on the angular position of the shaft 852. As discussed above, the shaft 852 typically would be supported within a vehicle chassis or frame to move with the vehicle along a guide track and to be able to freely pivot about rotation axis 831.

At the other end 854, the cam shaft 852 is mechanically coupled to a cam follower attachment element (or ring) 856. In this embodiment, a gear assembly 858 is provided to couple the ring 856 to the shaft 852 at or near end 854. A set of cam followers are attached to the ring 856, and these would be used to engage or abut a set of cam rails (not shown). As shown, a first or upper cam follower 860 is provided that has a pair of arms spaced apart 180 degrees about the ring 856 and extending outward in a first mounting or rotation plane. Each arm includes a pivotally mounted cam wheel or roller 862, 863 that would be used to contact a cam rail positioned in the same plane or height as follower 860 (e.g., a cam rail segment provided near a guide track for the vehicle) to cause the rotation of shaft 852 about axis 831. A second or intermediate follower 864 is provided that has a pair of arms extending out of and rigidly attached to opposite sides of the ring 856, and the arms include rollers/wheels 866, 867 that engage cam rails. A third or lower follower 870 is provided that has a pair of arms extending out of opposite sides of ring 856, with rollers/wheels 872, 873 for engaging an associated cam rail(s).

As shown in FIG. 8, the cam followers 860, 864, 870 are in parallel but spaced apart mounting or rotation planes (which may be transverse or even orthogonal to rotation axis 831). As shown in FIG. 9, the cam followers 860, 864, 870 are angularly offset about the circumference of the ring 856 with the first cam follower 860 offset by 60 degrees from the follower 864 positioned in an adjacent plane and follower 870 offset another 60 degrees from the follower 864 (also in an adjacent plane). In this arrangement, one follower arm is provided in 60 degree increments on the ring 856 to allow contact with cam rails and efficient positioning of the shaft 852 in a full rotation (360 degrees of rotation or positioning) in either direction.

The gear box or geared coupling 858 of ring 856 and shaft 852 may take many forms to practice the invention. The cam follower assembly may be geared such that more than one rotation of the cam ring 856 is used to affect a single rotation of the shaft 852 (and a payload), or the gearing may be the opposite to cause the shaft 852 to rotate a full rotation with less than a full rotation of the ring 856. The former arrangement may be desirable, though, to reduce the cam follower/rail forces, allow for smaller sized cam follower arms, provide higher precision for the payload orientation, or any combination of these design parameters or characteristics. For example, when compared with an ungeared system, the inclusion of a 4:1 gear reduction between the ring 856 and shaft 852 with gear assembly 858 may include the following options: (1) with the same diameter/sized cam follower, the applied cam forces may be reduced to approximately one fourth the ungeared forces; (2) with the same applied cam forces, the cam follower size/diameter may be reduced to approximately one fourth the ungeared size/diameter; and/or (3) applied cam forces may be cut approximately in half and the cam follower diameter/size may be reduced by approximately fifty percent.

As shown, the cam-based positioning assemblies may be adapted to use vehicle motion to get vehicle/payload rotation with accurate rotation/positioning. Cam rails may be provided on one side of the guide track (or follower arms) at a time along a segment of the guide track, and the cam rails are used to push or retard travel of an arm so that the cam rails used to force or control rotation may be provided on an opposite side than the side and/or direction that is being rotated (e.g., rails on a left side of a DOT may be used to cause counterclockwise rotation while rails on a right side of a DOT may be used to create clockwise rotation of cam shaft). Typically, only one follower arm is being used to drive rotation and is engaging a rotation/position control segment of an associated cam rail, and then a hand-off is performed to another adjacent follower arm (e.g., an adjacent arm at an angular offset such as one 60 degrees in either rotation direction when 3 followers/6 arms are utilized).

As shown in FIGS. 1-9, a form of compliance is provided in the ride system to ensure contact between cam followers and cam rails. The nature of the compliance may depend upon the loads involved for the ride system. The compliance components may take the form of wheels or rollers with urethane or similar coatings. Long lengths of cam rails are shown in some figures, but it will be understood that short segments would more likely be provided where contact/engagement occurs with the follower arms so as to reduce fabrication and other costs (e.g., discontinuous cam rails associated with each follower providing a plurality of contact segments where that roller is used to control/force rotation and/or to limit over rotation).

The term "cam follower" is often used in the industry for a flat faced or roller companion to a cam shaft that is used to transfer the action of the cam shaft to a valve train or other mechanism, and, in this description "cam follower" or follower arm is used more broadly to cover a component or member such as an arm that extends outward from a cam shaft or rotational element linked to a cam shaft that may be used to selectively cause the cam shaft to rotate (e.g., when a wheel or roller on the follower arm engages a sloped or inclined segment of a cam rail that causes it to follow the sloped contact surface of the rail).

The above discussion highlights the use of the new concepts to provide a cam-based drive for continuous, uninterrupted rotation in either direction (without unwinding) up to or more than 360 degrees about a rotational axis of a payload platform or assembly. This is useful with many ride designs, but it has much broader applications as well. More generally, the above description and accompanying figures should be understood as teaching a cam apparatus that is useful for positioning a payload assembly as the payload assembly is caused to travel along a track (with the term "track" intended to be construed loosely to encompass nearly any mechanism or assembly of mechanisms useful for guiding travel of a payload assembly through a facility or outdoors). The cam apparatus includes a number of force imparting elements positioned proximate to the track (such as but not limited to the cam rails shown in the figures). The cam apparatus also includes a follower mechanism linked to the payload assembly, and this follower mechanism may include force transmission elements interacting with each of the force imparting elements when the payload assembly travels along the track. Also, the cam apparatus may include a mechanical orientation assembly that is linked to the payload assembly and the follower mechanism constraining interaction between the force imparting elements and the force transmission elements.

In the cam apparatus, the force imparting elements and the force transmission elements are arranged such that rotational motion is produced in the follower mechanism to selectively position the payload assembly about its rotational axis with the payload assembly position being related to a relative linear displacement between the follower mechanism and the force imparting elements. Also, in the cam apparatus, the force imparting elements and the force transmission elements are arranged such that the forces producing rotation motion of the follower assembly that are applied to the payload assembly are transferred from a first pair of one of the force imparting elements and one of the force transmission elements to a second pair of another one of the force imparting elements and another one of the force transmission elements, whereby the rotation motion of the follower assembly may continue in either of the clockwise and counterclockwise directions free of interruption or limit.

In some embodiments (similar to those shown in the figures), the cam apparatus may include six force imparting elements that are positioned in three pairs, with each of the pairs positioned in three planes orthogonal to the rotational axis of the payload assembly (with these three planes being offset from each other along the rotational axis). The force imparting elements of each of the pairs are spaced apart on opposite sides of the rotational axis such that the force imparting elements of each of the pairs concurrently contact the force transmission elements. More particularly, each of the pairs of the force transmission elements may include a pair of arms extending outward from a hub with a central axis coinciding with the rotational axis and being offset about the rotational axis by about 180 degrees. Further, in some embodiments, each of the pairs of the force transmission elements may be offset by about 60 degrees relative to the rotational axis from a next one of the pairs such that one of the arms extends from the hub at 60-degree increments. In some cases, the mechanical assembly may include mechanical devices such as gears, chains, belts, or the like between the follower mechanism and the payload assembly operating to provide a resultant rotational movement of the payload assembly that is greater than or less than the rotation of the follower mechanism relative to the rotational axis of the payload assembly.

We claim:

1. An amusement park ride adapted for rotating a passenger compartment on a vehicle support in response to movement relative to a guide track defining a ride path for the amusement park ride, comprising:

a vehicle chassis engaging the guide track to travel along the ride path during operation of the amusement park ride; and a cam-based positioning assembly supported by the vehicle chassis, wherein the cam-based positioning assembly is connected to the vehicle support and operates in response the travel of the vehicle chassis to rotate the passenger compartment, wherein the cam-based positioning assembly comprises a cam shaft pivotally mounted within the vehicle chassis and having an end extending into the vehicle platform to provide a rotating output to rotate the passenger compartment, and wherein the cam-based positioning assembly includes first, second and third cam followers connected to the cam shaft and extending outward from the cam shaft at angular offsets of about 60 degrees from an adjacent one of the cam followers.

2. The ride of claim 1, wherein the cam-based positioning assembly operates to first rotate the passenger compartment in a counterclockwise direction and to second rotate the passenger compartment in a clockwise direction at first and second segments of the guide track and wherein the cam-based assembly is operable to rotate the passenger compartment 360 degrees about a rotation axis.

3. The ride of claim 1, wherein the first, second, and third cam followers have longitudinal axes extending in first, second, and third rotation planes, respectively, with the rotation planes being parallel and with adjacent one of the rotation planes being spaced apart along the cam shaft.

4. The ride of claim 3, wherein the cam-based positioning assembly further comprises a first cam rail, a second cam rail, and a third cam rail each extending along at least a portion of the guide track and providing contact surfaces for the first, second, and third cam followers, respectively, to provide a rotation force for selectively rotating the cam shaft.

5. The ride of claim 4, wherein the contact surfaces are inclined relative to the guide tracks, wherein the cam rails have profiles defining an angular position of the cam shaft at each point along the guide track, and wherein one of the cam followers engages one of the contact surfaces to apply the rotation force causing rotation of the cam shaft in a first direction and one of the cam followers concurrently engages one of the contact surfaces to limit rotation of the cam shaft in the first direction.

6. A ride system, comprising:

a guide track defining a ride path;

a vehicle chassis rollably engaging the guide track; and a positioning assembly comprising first, second, and third cam rails and a cam mechanism including a cam shaft and first, second, and third pairs of cam follower arms extending outward from the cam shaft, wherein the cam rails provide contact surfaces with a profile defining a position of each of the follower arms along a length of the guide track to set an angular position of the cam shaft and wherein the first, second, and third pairs of cam follower arms are each provided in a rotational plane such that the planes are orthogonal to the cam shaft and are spaced apart and parallel to each other.

7. The ride system of claim 6, wherein the first cam rail is positioned in the rotation plane of the first pair of cam follower arms, the second cam rail is positioned in the rotation plane of the second pair of cam follower arms, and the third cam rail is positioned in the rotation plane of the third pair of cam follower arms.

8. The ride system of claim 6, further wherein at least one of the cam follower arms engages one of the contact surfaces along the length of the guide track.

9. The ride system of claim 8, wherein the at least one of the cam follower arms engaging the one of the contact surfaces provides a rotational force to position the cam shaft and wherein a second one of the cam follower arms concurrently engages one of the contact surfaces to provide a counter-rotational force in an opposite direction to control over rotation of the cam shaft.

10. The ride system of claim 6, wherein the follower arms in each of the pairs are angularly offset by 180 degrees about the cam shaft.

11. The ride system of claim 10, wherein each of the follower arms is angularly offset from an adjacent one of the follower arms about the cam shaft by about 60 degrees.

12. A payload delivery system, comprising:

a vehicle track with two or more cam rails extending along segments of the vehicle track;

a payload support adapted for rolling on the vehicle track and for supporting a rotatable payload; and a cam mechanism including a cam shaft extending into the payload support to provide a rotation output to selectively rotate the rotatable payload, wherein the cam mechanism further includes two or more cam follower arm pairs extending outward from opposite sides of the cam shaft and selectively engaging the cam rails to rotate the cam shaft to provide the rotation output when the payload support rolls in either direction along the vehicle track.

13. The system of claim 12, wherein the cam mechanism include three of the cam follower arm pairs and wherein each of the cam follower arm pairs extends along a longitudinal axis and wherein the axes are in three different planes that are parallel and spaced apart along the cam shaft.

14. The system of claim 13, wherein each of the cam follower arms is angularly spaced apart from an adjacent one of the cam follower arms by about 60 degrees.

15. The system of claim 12, wherein the cam rails provide at least one contact surface for engaging one of the cam follower arm pairs along the length of the vehicle track, whereby continuous engagement between the cam rails and the cam follower arm pairs is provided to angularly position the cam shaft.

* * * * *